United States Patent [19]

Landry

[11] Patent Number: 4,750,711

[45] Date of Patent: Jun. 14, 1988

[54] POST PULLER

[76] Inventor: Ronnie J. Landry, Hwy. 70, P.O. Box 87, Pierre Part, La. 70339

[21] Appl. No.: 831,922

[22] Filed: Feb. 19, 1986

[51] Int. Cl.[4] ..... E21B 19/00

[52] U.S. Cl. ..... 254/30

[58] Field of Search ..... 254/8 R, 120, 131; 132, 254/29 R, 30, 31; 28/97, 24; 414/444

[56] References Cited

U.S. PATENT DOCUMENTS

| | | | |
|---|---|---|---|
| 114,730 | 5/1871 | Wagner et al. . | |
| 345,467 | 7/1886 | Williams . | |
| 461,689 | 10/1891 | Sherman . | |
| 513,129 | 1/1894 | Miller . | |
| 862,495 | 8/1907 | Mason . | |
| 900,455 | 10/1908 | Weir . | |
| 909,297 | 1/1909 | Helgeson . | |
| 2,341,106 | 2/1944 | Kuzeld | 254/30 |
| 2,377,399 | 6/1945 | Brumfield . | |
| 2,499,458 | 3/1950 | Campbell | 280/47.24 |
| 2,662,777 | 12/1953 | Wilchek . | |
| 3,913,762 | 10/1975 | Alexander . | |

*Primary Examiner*—Robert C. Watson

*Attorney, Agent, or Firm*—Reginald F. Roberts, Jr.

[57] ABSTRACT

A device for pulling fence posts from the ground, and for digging holes for the emplacement of fence posts. One embodiment comprises a substantially T-shaped member pivotally mounted on a shaft. A second embodiment comprises a rigid triangular member pivotally mounted on a shaft. Each embodiment further comprises a pair of wheels mounted on the shaft, which thereby serves as an axle for the wheels. Two very important advantages of the first and second embodiments are (1) a continuously variable mechanical advantage and (2) automatic adjustment of the distance of the device from the fence post being pulled up for maximum efficiency. A third embodiment of the invention comprises a digging machine connected to one of the first two embodiments. Either of the first two embodiments are also useful for transporting fence posts or other materials needed in laying fences, or for stringing wire between fence posts.

6 Claims, 8 Drawing Sheets

POST PULLER

BACKGROUND OF THE INVENTION

The present invention relates to fences. More particularly, the invention relates to uprooting fence posts from the ground.

It is present practice to uproot fence posts by manually pulling them up from the ground where they are embedded. This practice is laborious, inefficient, and wasteful of manpower.

SUMMARY OF THE INVENTION

In general, the present invention provides in one aspect a mechanical device for pulling fence posts from the ground. One embodiment of the device comprises a substantially T-shaped rigid member pivotally mounted on a shaft. A second embodiment comprises a rigid triangular member pivotally mounted on a shaft.

In a second aspect, the invention provides a post-hole digger. One embodiment of the post-hole digger comprises a substantially T-shaped rigid member pivotally mounted on an axle, supported by a pair of wheels, in combination with a digging device. The T-shaped member comprises a first elongated rigid member pivotally mounted on the axle, send a second elongated rigid member fastened perpendicularly to the first elongated member. The digging device includes a motor connected to an auger with a bit at one end of the auger, and with windings about the length of the auger. The digging device is pivotally connected to one end of the second elongated member, and the motor is used to drive the auger while controlling the digging operation with the other end of the second elongated member.

A second embodiment of the post-hole digger comprises a mechanical device which includes a rigid triangular member mounted at a first apex thereof on an axle supported by a pair of wheels, in combination with a digging device which includes a motor connected to an auger. The auger has a bit at one of its ends, and windings about its length. The digging device is pivotally connected to a second apex of the triangular member, and the motor is used to drive the auger while controlling the digging operation with the third apex of the triangular member.

In a third aspect, the invention provides a method for extracting a post from the ground. One embodiment of the method comprises the following steps:

(a) providing a mechanical device which includes a substantially T-shaped rigid member comprising a first elongated rigid member pivotally mounted on an axle supported by a pair of wheels, and a second elongated rigid member fastened perpendicularly to the first elongated member;

(b) connecting the post to one end of the second elongated member; and (c) applying a downward force to the other end of the second elongated member.

A second embodiment of the method comprises (a) providing a mechanical device which includes a rigid triangular member mounted at a first apex thereof on an axle supported by a pair of wheels;

(b) connecting the post to a second apex of the triangular member; and (c) applying a downward force to the third apex of the triangular member.

In a fourth aspect, the invention provides a method for stringing wire. The method comprises, in a first embodiment, (a) providing a mechanical device which includes a substantially T-shaped rigid member comprising a first elongated rigid member pivotally mounted on an axle supported by a pair of wheels; a second elongated rigid member fastened perpendicularly to the first elongated member; and a rigid, transverse, substantially L-shaped member fastened to the second elongated member;

(b) looping a spool of wire around the transverse L-shaped member;

(c) fastening one end of the spool of wire to a first post embedded in the ground;

(d) rolling the mechanical device away from the first post to a second embedded post; and (e) fastening the wire to the second post, thereby stringing the wire between the first and second posts.

In a second embodiment, the method comprises (a) providing a mechanical device which includes a rigid triangular member mounted at a first apex thereof on an axle supported by a pair of wheels; and a rigid, transverse, substantially L-shaped member fastened to the side of the triangular member opposite the first apex thereof;

(b) looping a spool of wire around the transverse L-shaped member;

(c) fastening one end of the spool of wire to a first post embedded in the ground;

(d) rolling the mechanical device away from the first post to a second embedded post; and (e) fastening the wire to the second post.

In a fifth aspect the invention provides a method for digging a hole. One embodiment of the method comprises (a) providing a mechanical device which includes a substantially T-shaped rigid member comprising a first elongated rigid member pivotally mounted on an axle supported by a pair of wheels, and a second elongated rigid member fastened perpendicularly to the first elongated member;

(b) providing a digging device which includes a motor connected to an auger with a bit at one end thereof and windings about the length thereof;

(c) pivotally connecting the digging device to one end of the second elongated member; and (d) using the motor to drive the auger while controlling the digging operation with the other end of the second elongated member.

A second embodiment of the method comprises (a) providing a mechanical device which includes a rigid triangular member mounted at a first apex thereof on an axle supported by a pair of wheels;

(b) providing a digging device which includes a motor connected to an auger with a bit at one end thereof and windings about the length thereof;

(c) pivotally connecting the digging device to a second apex of the triangular member; and (d) using the motor to drive the auger while controlling the digging operation with the third apex of the triangular member.

These and other aspects of the invention will be apparent to those skilled in the art from the foregoing description and from the more detailed description which follows.

DESCRIPTION OF THE PREFERRED EMBODIMENTS

The following description illustrates the manner in which the principles of the present invention are applied, but is not to be construed as in any sense limiting the scope of the invention.

More specifically, the present invention provides a mechanical device which includes a lever with a continuously variable mechanical advantage. This device is particularly useful for pulling up feace posts. It may, however, be used in many other services and applications, as will be clear to those skilled in the art from the following detailed description.

Figure 1:
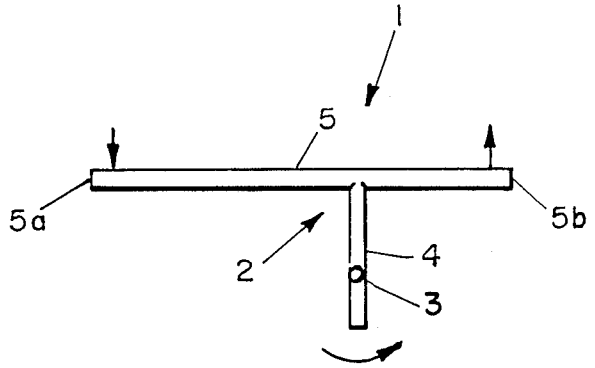
FIG. 1 is a mid-sectional view of a first embodiment of the present invention.

FIG. 1 shows a mid-sectional side view of a first embodiment of a device 1 made in accordance with the principles of the present invention. The device 1 comprises a T-shaped member 2 which includes a first elongated rigid member 4 mounted on a sheft 3. The first member 4 is connected to a second elongated rigid member 5 is a substantially perpendicular configuration. The first and second members 4 and 5 define submembers 5*a* and 5*b* of the second member 5 by relationship of the submembers 5*a* and 5*b* to the junction of the members 4 and 5. This relationship may be further defined in terms of the relative lengths of the submembers 5*a* and 5*b*. Preferably these lengths are unequal, as may be seen in the drawing figure.

Also shown in FIG. 1 is a schematic representation, indicated by arrows, of forces acting on the device 1 and on the T-shaped member 2. A downward force applied to the end of submember 5*a* imparts an upward force to the end of submember 5*b* and a counterclockwise torque to the member 2. These forces act through lever arms of variable lengths. By way of illustration, when the device 1 is in the position shown in the drawing, in which it is to be understood that the member 5 is horizontal and parallel to the ground, the ratio of the lever arms is the ratio of the length of submember 5*a* to the length of submember 5*b*. This ratio also represents the mechanical advantage of the device 1 in the position shown in FIG. 1. Raising the end of submember 5*a* causes a decrease in mechanical advantage, while lowering the end of submember 5*a* causes a corresponding increase. This variability of mechanical advantage is of great benefit in applications such as pulling up fence posts from the ground.

By way of illustration, it would be beneficial for the job of pulling up a fence post to be initiated, after the end of the submember 5*b* was securely connected to the post, by placing the device 1 in the position indicated in FIG. 1, with the member 5 horizontal end parallel to the ground, or in a position in which the end of the submember 5*a* is lower than the end of the submember 5*b*. By so doing, the mechanical advantage would be equal to or greater than the ratio of the length of submember 5*a* to submember 5*b*. A relatively great mechanical advantage is beneficial in the initial stage of the operation because, with the post firmly embedded in the soil, the maximum force would be required to dislodge it. Once the post has been dislodged, a lesser force is required to finish removing it from the ground. At this point it would be advantageous to temporarily disconnect the post and reposition the device 1 so that the end of submember 5*a* is substantially higher than the end of submember 5*b*. Alternatively, the chain 26 could be double-looped around the post, and by rachet action the chain 26 would reposition itself as the post was pulled from the ground. In either case, this more efficient utilization is the result of a higher ratio of upward movement of the end of submember 5*b* to downward movement of submember 5*a*.

The principle just illustrated applies to all embodiments and modifications of the invention.

Figure 2:
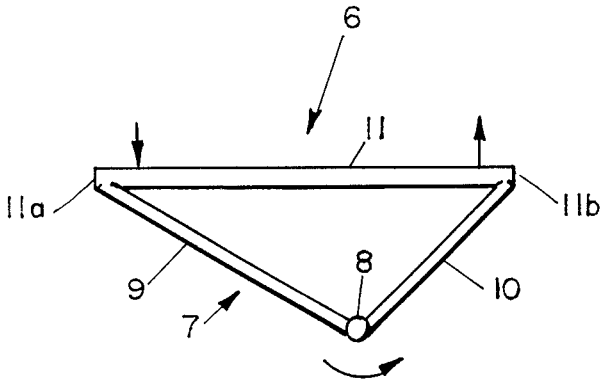
FIG. 2 is a mid-sectional side view of a second embodiment of the invention.

A second embodiment of the invention is shown in FIG. 2, and is generally indicated therein by the numeral 6. This embodiment 6 of the invention comprises a triangular member 7 mounted on a shaft 8 at an apex of the triangle defined by first, second, and third sides 9, 10, and 11, respectively. The member 7 is preferably mounted on the shaft 8 at the apex defined by the junction of the first and second sides 9 and 10. Even more preferably, the lengths of the sides 9, 10, and 11 are so proportioned that side 11 is longer than side 9, and side 9 is longer than side 8, thereby defining a scalene triangle. The same principles that were explained and illustrated with respect to the first embodiment 1 of the invention apply to this second embodiment 6 thereof.

Figure 3:
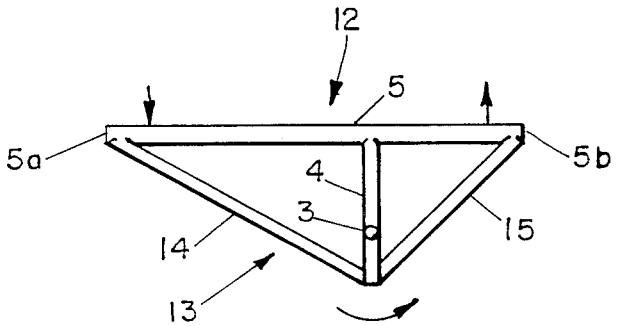
FIG. 3 is a mid-sectional side view of a modification of the first embodiment of the invention.

The device 1 may be braced by the inclusion of additional members, leading to the modification shown at 12 in FIG. 3. In this modification 12, third and fourth elongated members 14 and 15 are used to brace the device 12, the first, second, third, and fourth members 4, 5, 14, and 15 forming in combination a bi-triangular member 13 mounted on the shaft 3.

Figure 4:
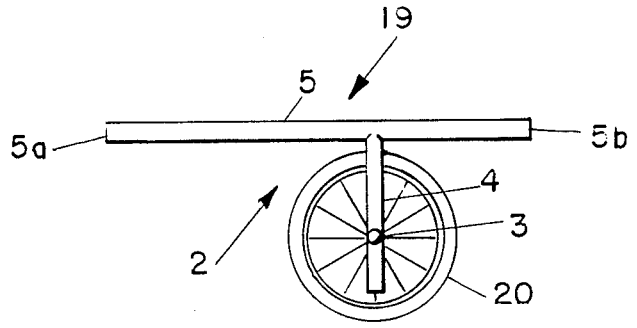
FIG. 4 is a mid-sectional side view of a second modification of the first embodiment of the invention.

The device 1 may also be modified by utilizing the shaft 3 as an axle 3 for mounting a pair of wheels 20, as shown at 19 in FIG. 4. The device 1 is thereby transformed into a mobile device 19. More importantly, the wheels 20 provide a second significant advantage by maintaining the device 19 in its most efficient configuration relative to a post being pulled from the ground. Without the wheels 20, only the horizontal position of the member 5 provides a configuration in which all of the force is directed upward by the other end of the submember 5*b*. In all other orientations in which there is a fixed distance between the device 1 and the post, there will be a lateral force acting on the post, which necessarily diminishes the upward force thereon. Another way of stating the situation is that the lifting operation would "bind" the post. However, with the wheels 20 attached to the shaft and axle 3 as shown, this lateral component of the force would result in an equal and opposite lateral force acting on the device 19. The result is that the wheels 20 roll and vary the distance between the wheels 20 and the post as the operation proceeds, thereby providing the maximum available lifting force and the minimal lateral force on the post.

Figure 5:
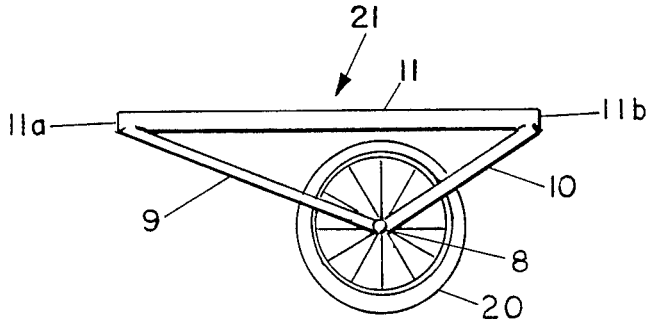
FIG. 5 is a mid-sectional side view of a modification of the second embodiment of the invention.

The second embodiment 6 may also be modified as shown at 21 in FIG. 5, by mounting a pair of wheels 20 on the shaft 8, which then serves as an axle 8 for the wheels 20. The function of this modification 21 of the device 6 is similar to the modification 19 of the device 1 described above, and provides the same advantage with respect to the efficient utilization of the device 21.

Figure 6:
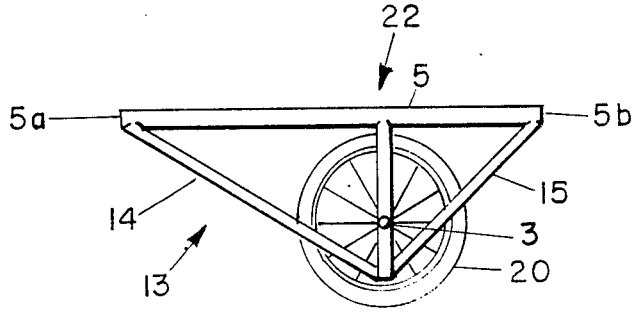
FIG. 6 is a side view of a third modification of the first embodiment of the invention.

The modification 12 of the first embodiment 1 may be further modified as shown at 22 in FIG. 6 by including a pair of wheels 20 mounted on the shaft 3, which thereby serves as an axle 3. The function of this modification 22 is similar to the modifications 19 and 21 just described, and provides the same advantage with respect to the efficient utilization of the device 22.

Figure 7:
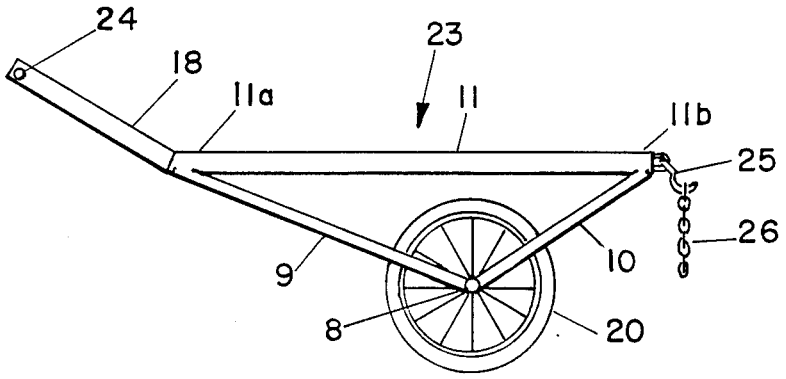
FIG. 7 is a mid-sectional side view of a second modification of the second embodiment of the invention.
Figure 8:
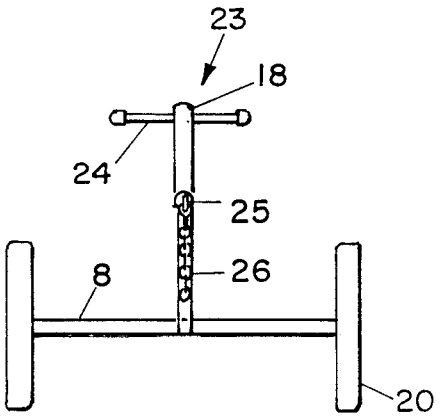
FIG. 8 is a front view of the modification shown in FIG. 7.

The device 6 may be further modified for greater utility, as shown at 23 in FIGS. 7 and 8. The further modifications include the addition of a fifth elongated rigid member 18 extending beyond one end of the elongated member 11 in substantially the same direction as the elongated member 9, fastening a handle 24 to the member 18, and providing means for securely connecting a fence post to the other end of the elongated member 11. The connecting means may, for example, include a hook 25 from which depends a chain 26. The chain 26 is securely fastened to the fence post that is to be pulled up.

Figure 9:
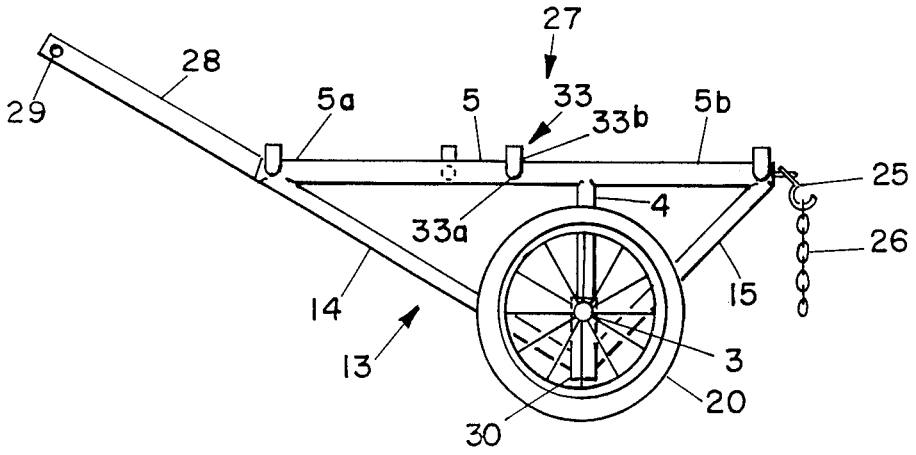
FIG. 9 is a side view of a fourth modification of the first embodiment.
Figure 10:
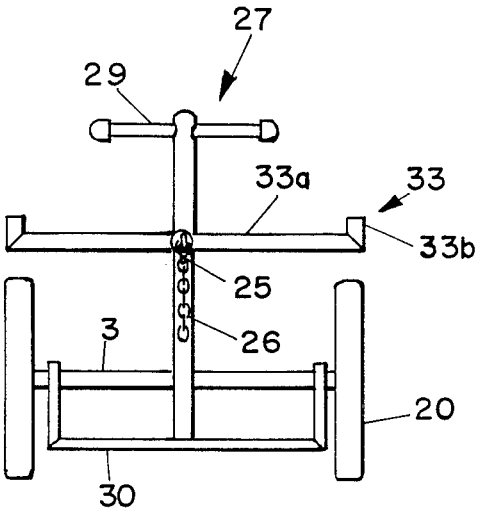
FIG. 10 is a front view of the modification shown in FIG. 9.
Figure 11:
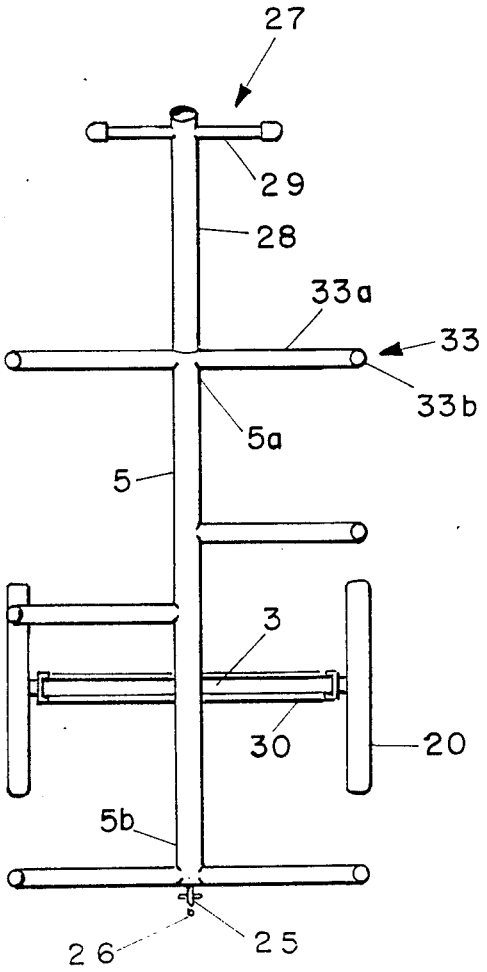
FIG. 11 is a top plan view of the modification shown in FIG. 9.

The device 1 may be further modified as shown at 27 in FIGS. 9, 10, and 11. The additional modifications include a fifth elongated rigid member 28 extending beyond one end of the elongated member 5 in substantially the same direction as the elongated member 14; fastening a handle 29 to the member 28; using a rigid U-shaped member 30 to connect the first, third, and fourth elongated members 4, 14, and 15; providing means such as the hook 25 and chain 26 for securely connecting a fence post to the other end of the elongated member 5; and fastening a plurality of rigid transverse L-shaped members 33 comprising a pair of substantially perpendicular members 33*a*, 33*b* to the second elongated member 5. The U-shaped member 30 serves as additional bracing means, and the L-shaped members 33 provide capability for transporting a load of fence posts, fence boards, or other structures while confining the structures within the enclosure defined by the second member 5 and the L-shaped members 33. In the absence of such confining means, the posts or other structures could easily fall from the device 27. The L-shaped members 33 also beneficially act as a ladder for a person working on a fence. The staggered configuration of the L-shaped members 33 is beneficially adapted to their function as a ladder.

Even more specifically, in FIGS. 9–14, the radius of the wheel 20 is approximately equal in length to that of the first elongated member 4. Preferably, the radius of the wheel 20 is approximately equal to about two-thirds of the length of the member 4. Even more preferably, the ratio of the lengths of the members 4, 5, 14, and 15 is about 1.4, 4.3, three, and two to one, respectively. Most preferably the lengths of the members 4, 5, 14, and 15, and the radius of the wheel 20 are nineteen, 57.5, 40.25, 27.5, and 13.25 inches, respectively. In FIGS. 5, 7, and 8, the radius of the wheel 20 is approximately equal to but slightly less than the altitude of the triangle defined by sides 9, 10, and 11. Preferably, the radius of the wheel 20 is about thirteen inches.

The versatility of the present invention will now be further illustrated by the following examples and applications.

Figure 12:
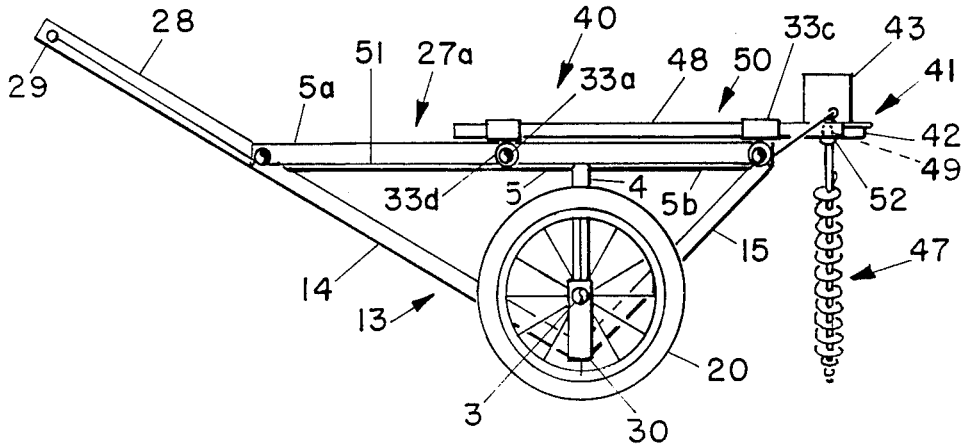
FIG. 12 is a schematic representation of a post-hole digger made in accordance with the principles of the present invention.

FIG. 12 shows a post-hole digger 40 made in accordance with the principles of the present invention. The post-hole digger 40 comprises a digging machine 41 connected by a pivot plate 42 to one end 5*b* of the member 5 of a mechanical device 27*a*. The device 27*a* is constructed like the device 27, except that the members 33*b*, 25, and 26 are excluded therefrom.

The machine 41 comprises a motor 43 which drives an augar 47. The post-hole digger 40 and digging machine 41 are controlled with the handle 29 of the mechanical device 27*a*. The degree of inclination of the member 5 is controlled by an upward or a downward force exerted on the handle 29. The speed of the motor 43 is regulated by means of a throttle-control linkage 51 from the motor 43 to the handle 29.

Figure 16:
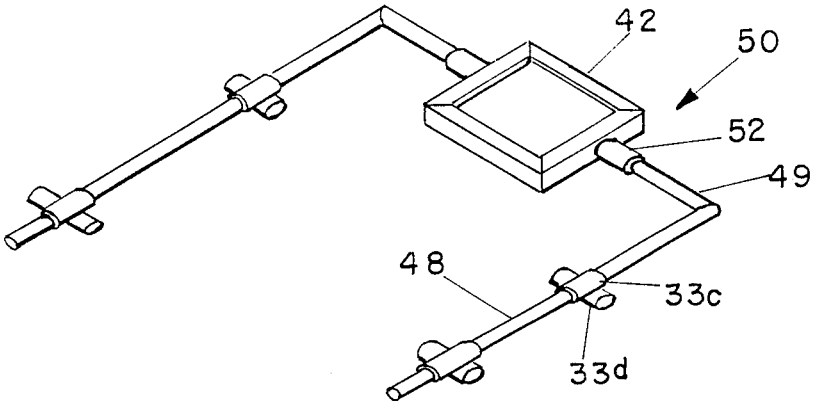
FIG. 16 is a pictorial view of a portion of the post-hole digger shown in FIG. 12.

The digging device 41 further includes a frame 50 fastened to the device 27*a*. The structure of the frame 50 is best seen in FIG. 16. As shown therein, the frame 50 includes a pair of parallel members 48, each of which is joined to one end of a cross-member 49. The other end of the member 49 is pivotally connected to the pivot plate 42 by a sleeve 52. The pivot plate 42 provides support for the motor 43.

One end of each member 33*a* is disposed in a sleeve 33*d*, and is rigidly fastened thereto by set screws (not shown). The member 48 is likewise disposed in a sleeve 33*c*, thereby providing support for the cross-member 49.

Figure 13:
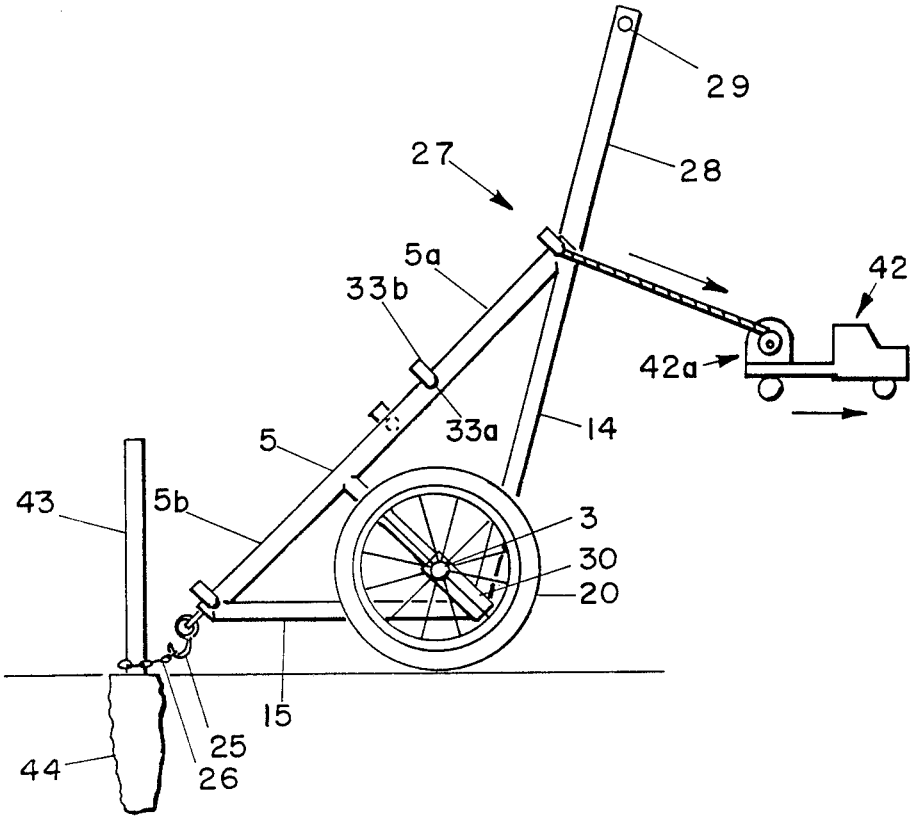
FIG. 13 is a schematic representation of a mechanized post-puller made in accordance with the principles of the present invention.

If so desired, the device 27 can be combined with a truck or other automotive vehicle. This combination, which greatly increases the power of the device 27, is illustrated in FIG. 13. A truck 42 is chained or roped by towing means 42*a* to the device 27 at the junction of members 5, 14, and 28. A fence post 43 to be pulled from the ground 44 is chained to the hook 25 which is fastened to the end 5*b* of the member 5. By pulling with the truck 42 in the direction indicated by the arrows, a very strong force is exerted upward on the fence post 43, causing it to be easily extracted from the ground 44. The advantage of this combination is that the device 27 can be utilized to provide minimal mechanical advantage, thereby maximizing the ratio of upward movement of the submember 5*b* to the downward movement of the submember 5*a*. Under these conditions, the upward movement of the post is maximized, and the post 43 will be pulled up more rapidly. The loss of mechanical advantage is compensated for by the use of the motorized vehicle 42 to increase the power of the mechanical device 27.

Figure 14:
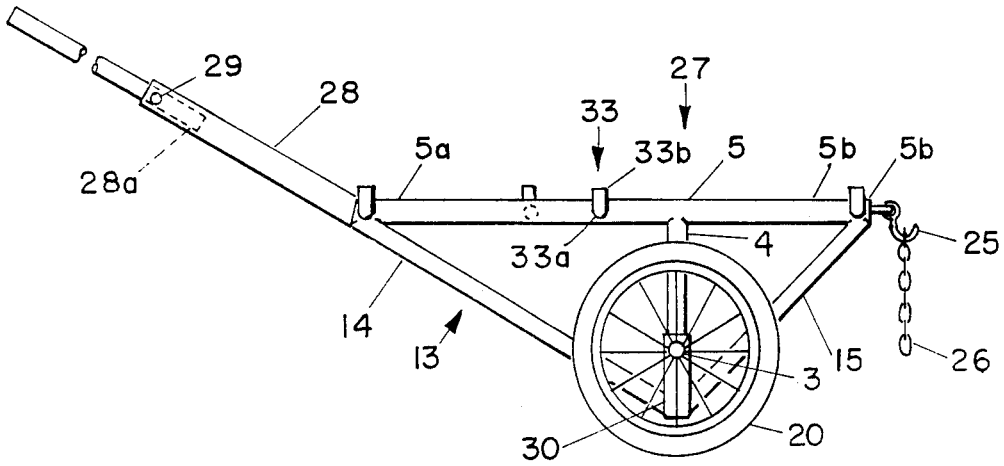
FIG. 14 is a schematic representation of the use of a "cheater" to increase the leverage of the present invention.

In another embodiment, illustrated in FIG. 14, the mechanical advantage of the device 27 is increased by an elongated member 28*a* sometimes referred to as a "cheater." By extending the length of the member 28 in this manner, the mechanical advantage for any configuration of the device 27 is greatly increased.

Figure 15:
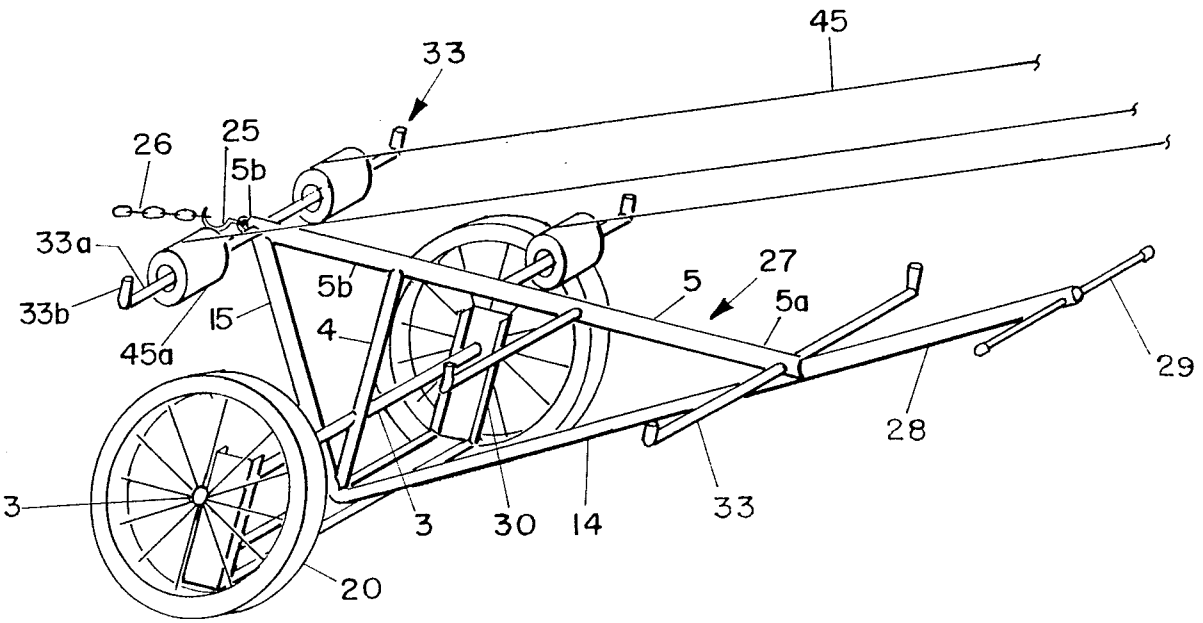
FIG. 15 is a schematic representation of the use of the present invention for stringing wire.

As a further illustration of its versatility, the device 27 can be used to string wire. An example of this application is shown in FIG. 15. With spools 45*a* of wire 45 on the members 33, the device 27 is rolled on the wheels 20, with one end of each wire 45 fastened to an embedded fence post (not shown). The wire 45 is then fastened to a second post, with the result that the wire 45 is strung between the first and second posts. This procedure is repeated until all of the wire has been strung.

While certain specific embodiments and details have been described for the purpose of illustrating the present invention, it will be apparent to those skilled in the art that various changes and modifications can be made therein without departing from the spirit and scope of the invention. For example, the device 1 as shown in FIG. 1 could be reversed by depending the T-shaped member 2 from the shaft 3 instead of mounting the member 2 on and above the shaft 3. While less desirable in general, such modification might be useful and beneficial in certain applications, and would fall within the scope of the present invention.

In view of the manifest versatility of his invention, as described and illustrated herein, the inventor hereby declares his intent to rely on the doctrine of equivalents to determine and assess the full scope of his invention as set out and defined in the following claims.

I claim:

1. A mechanical device for pulling up fence posts, comprising:

(a) a substantially T-shaped rigid member pivotally mounted on a shaft supported by a pair of wheels, the T-shaped member including a first elongated rigid member mounted on the shaft near one end of the first member, and a second elongated rigid member longer than the first member, the second member connected to the other end of the first member in a substantially perpendicular configuration, the distances from opposite ends of the second member to the point of connection to the first member substantially unequal, the radius of each wheel approximately equal in length to the length of the first elongated member;

(b) a third elongated rigid member connecting the other end of the first member to one end of the second member;

(c) a fourth elongated rigid member connecting the other end of the first member to the other end of the second member;

(d) a fifth elongated rigid member extending beyond one end of the second member in substantially the same direction as the third member;

(e) a handle fastened to the fifth member;

(f) means for connecting a post to the other end of the second member;

(g) a rigid, substantially U-shaped member connecting the first, third, and fourth elongated members to one another; and (h) a plurality of rigid, transverse, substantially L-shaped retaining members fastened to the second elongated member.

2. A mechanical device for uprooting fence posts, comprising:

(a) a rigid, triangular member having first, second, and third sides, the triangular member pivotally mounted on a shaft supported by a pair of wheels, the triangular member defining a scalene triangle, the triangular member mounted on the shaft at the apex of the triangular member opposite the longest side of the triangular member, the diameter of each wheel approximately equal in length to the altitude of the triangle;

(b) an elongated rigid member extending beyond one end of the longest side of the triangular member in substantially the same direction as the side of the triangular member that is of intermediate length;

(c) means for connecting a fence post to the other end of the side of the triangular member of intermediate length, said means including a hook fastened to the other end of the side of the triangular member, and a chain connected to the hook; and (d) a plurality of rigid, transverse, substantially L-shaped retaining members fastened to the longest side of the triangular member.

3. A mechanical device for pulling up fence posts, comprising:

(a) a substantially T-shaped rigid member pivotally mounted on a shaft supported by a pair of wheels, the T-shaped member including a first elongated rigid member mounted on the shaft near one end of the first member, the second member connected to the other end of the first member in a substantially perpendicular configuration, the distances from opposite ends of the second member to the point of connection to the first member substantially unequal, the radius of each wheel approximately equal in length to the length of the first elongated member; and (b) a plurality of rigid, transverse, substantially L-shaped retaining members fastened to the second elongated member.

4. The mechanical device of claim 1, further comprising:

(c) means for connecting a post to the other end of the second member.

5. A mechanical device for uprooting fence posts, comprising:

(a) a rigid, triangular member having first, second, and third sides, the triangular member pivotally mounted on a shaft supported by a pair of wheels, the triangular member defining a scalene triangle, the triangular member mounted on the shaft at the apex of the triangular member opposite the longest side of the triangular member, the diameter of each wheel approximately equal in length to the altitude of the triangle; and (b) a plurality of rigid, transverse, substantially L-shaped retaining members fastened to the longest side of the triangular member.

6. The mechanical device of claim 1, further comprising:

(c) means for connecting a fence post to the other end of the side of the triangular member of intermediate length.

* * * * *

UNITED STATES PATENT AND TRADEMARK OFFICE

CERTIFICATE OF CORRECTION

PATENT NO. : 4,750,711

DATED : June 14, 1988

INVENTOR(S) : Ronnie J. Landry

It is certified that error appears in the above-identified patent and that said Letters Patent is hereby corrected as shown below:

Column 8, line 44, Claim 4, "1" should read -- 3 --.

Column 8, line 62, Claim 6, "1" should read -- 5 --.

Signed and Sealed this

Thirtieth Day of August, 1988

*Attest:*

DONALD J. QUIGG

*Attesting Officer*

*Commissioner of Patents and Trademarks*